US005437075A

United States Patent [19]

Peake

[11] Patent Number: 5,437,075

[45] Date of Patent: Aug. 1, 1995

[54] SELF-STORING SHOE CLEANING BRUSH

[75] Inventor: Charles D. Peake, Kalamazoo, Mich.

[73] Assignee: PVM Enterprises, L.L.C., Kalamazoo, Mich.

[21] Appl. No.: 310,660

[22] Filed: Sep. 22, 1994

[51] Int. Cl.[6] ..... A47L 23/00; A47L 23/22

[52] U.S. Cl. ..... 15/161; 15/160

[58] Field of Search ..... 15/160, 161, 237, 238, 15/215, 210.1; 280/164.2

[56] References Cited

U.S. PATENT DOCUMENTS

| | | | |
|---|---|---|---|
| 1,130,292 | 3/1915 | Hussey . | |
| 1,157,631 | 10/1915 | McLaughlin . | |
| 1,584,968 | 5/1926 | Arnold . | |
| 2,217,570 | 10/1940 | Stroup | 15/215 |
| 2,962,744 | 12/1960 | Hodgin | 15/161 |
| 3,028,617 | 4/1962 | Racina | 15/161 X |
| 3,074,093 | 1/1963 | McDonald | 15/161 |
| 3,142,853 | 8/1964 | Hensley | 15/161 X |
| 3,747,150 | 7/1973 | Kozub | 15/105 |
| 5,075,917 | 12/1991 | Wheat et al. | 15/161 |
| 5,230,117 | 7/1993 | Johnson et al. | 15/106 |

FOREIGN PATENT DOCUMENTS

| | | | |
|---|---|---|---|
| 2232580 | 12/1990 | United Kingdom | 15/161 |

*Primary Examiner*—Edward L. Roberts, Jr.
*Attorney, Agent, or Firm*—Gifford, Krass, Groh, Sprinkle, Patmore, Anderson & Citkowski

[57] ABSTRACT

A golf cart mounted golf cleat cleaner includes a plate having a brush attached thereto. The brush is attached to a mounting bracket by a hinge which is preferably spring biased. The cleat cleaner also includes a brace which is attached to the brush plate by a hinge. The brace engages the attachment bracket on the golf cart, so as to support the brush plate in an approximately horizontal use position. The cleat cleaner may be folded into a storage position by disengaging the free end of the brace from the golf cart or attachment bracket.

12 Claims, 3 Drawing Sheets

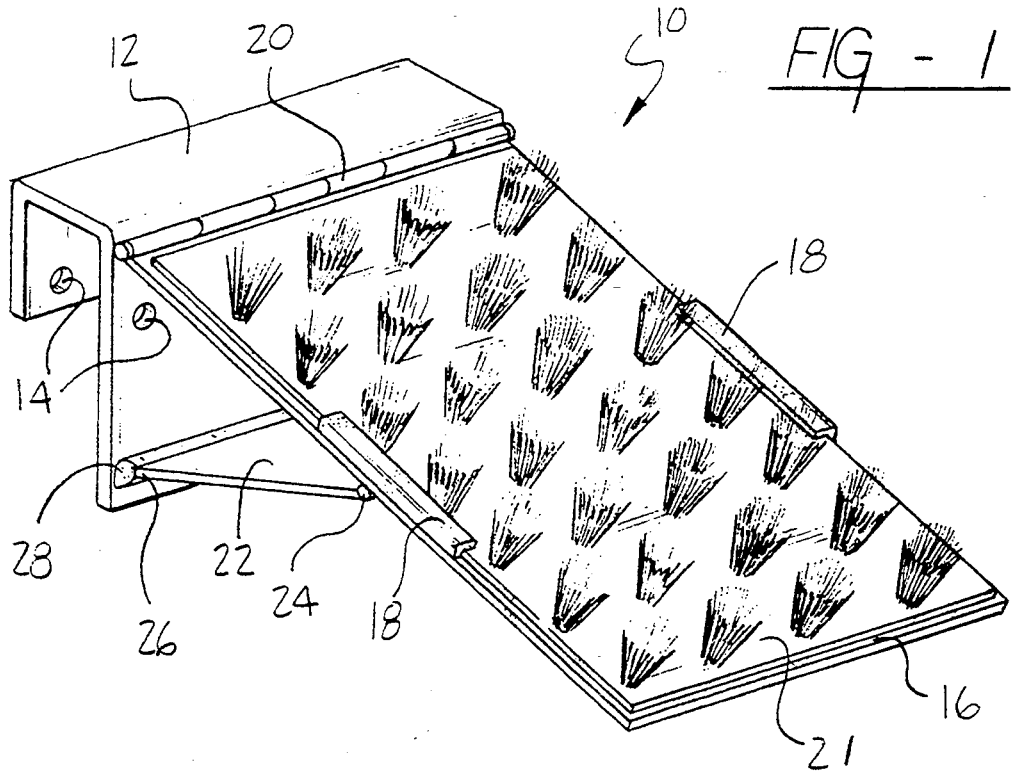
FIG - 1
FIG - 2
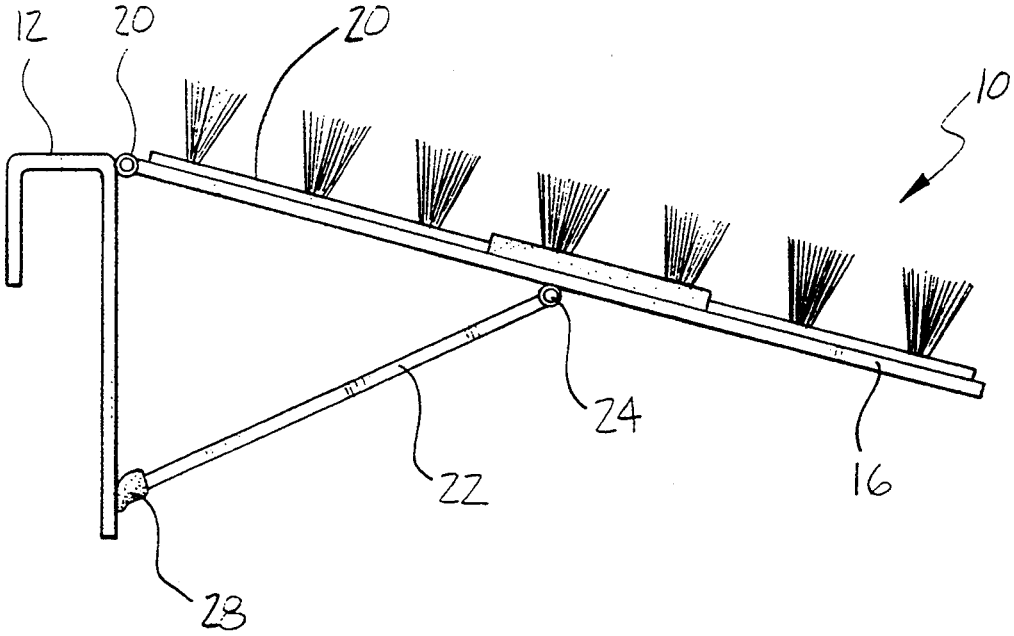

FIG - 3
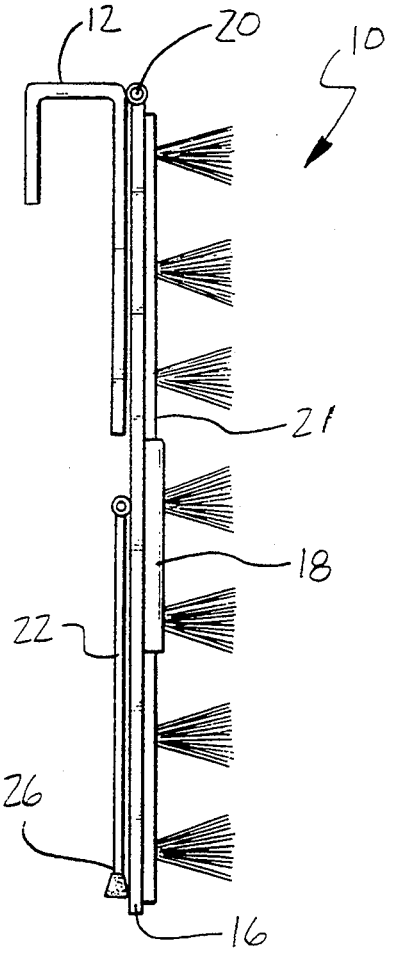
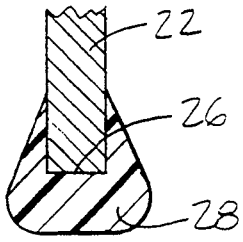
FIG - 5
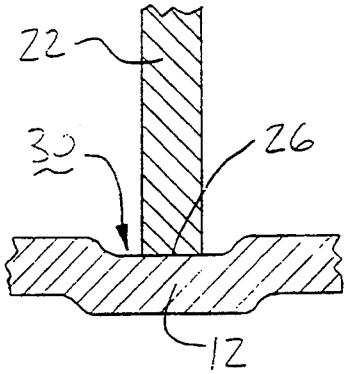
FIG - 6
FIG - 4
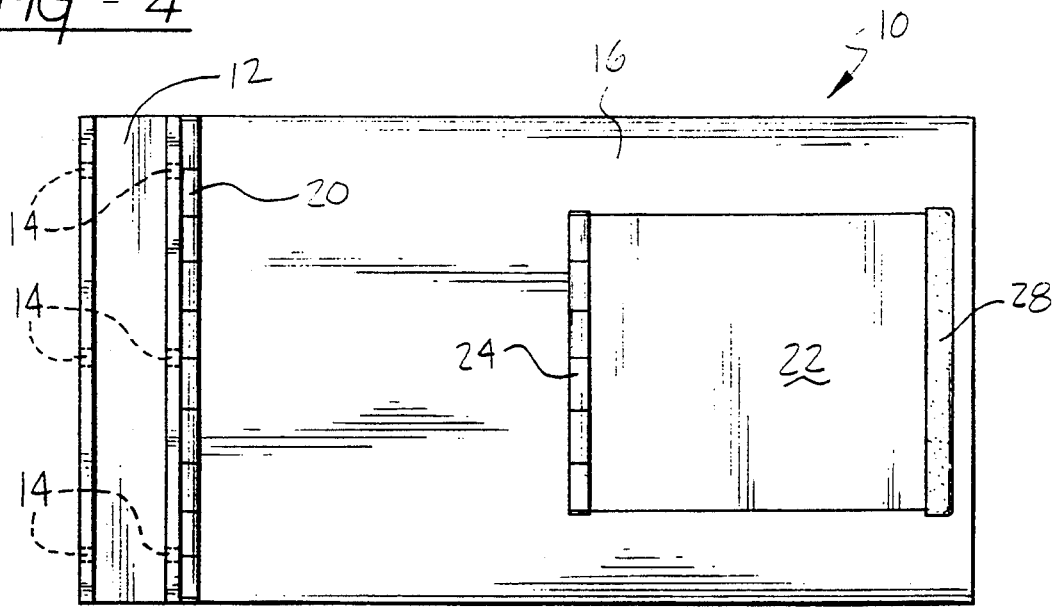

SELF-STORING SHOE CLEANING BRUSH

FIELD OF THE INVENTION

This invention relates generally to brushes. More specifically, the invention relates to brushes for cleaning mud and debris from shoes, particularly golf cleats. Most specifically, the invention relates to a self-storing cleat cleaner brush which is mountable onto a golf cart.

BACKGROUND OF THE INVENTION

Mud, grass, and other debris can collect on the cleats of golf shoes during a round of play and can create unstable footing leading to injury and/or poor shots. This problem is particularly severe after a rainstorm or when early morning dew is present on the golf course. In response to this problem, many golfing facilities provide cleat cleaning brushes at a number of locations throughout the course. However, in many instances, these brushes are not nearby when needed. Consequently, golfers often will clean their cleats with available items, such as sticks, keys or with their hands. In some instances, golfers carry individual cleat cleaning brushes, and U.S. Pat. No. 5,230,117 discloses a golf bag mounted cleat cleaning brush. All of such approaches require a golfer to stand on one foot, bend over, and scrape the bottom of his or her shoe. This action is cumbersome, and tends to slow play of the game.

Many golfers use golf carts, and it is convenient and desirable to mount cleat cleaning brushes onto the golf carts. U.S. Pat. No. 3,747,150 discloses a cleat cleaning brush which may be attached to the wheel of a golf cart by a quick release fitting. U.S. Pat. No. 5,075,917 discloses a cleat cleaner which may be mounted to the bumper of an automobile or golf cart. Problems are encountered with cart mounted cleat cleaning devices of the prior art because these devices must, of necessity, project from the cart at a location readily accessible to the golfer and, they must do so with sufficient rigidity to permit the golfer to scrub dirt from his or her cleats. The rigid mounting and accessible location of the prior art cleat cleaners can cause injury to a player who walks into a cleat cleaning brush or is struck by a cleat cleaning brush on a passing golf cart. Similarly, impact with a golfer, a tree or rough ground can damage the brush and/or cart. As disclosed in U.S. Pat. No. 3,747,150, a cleat cleaning brush may be mounted or demounted from the wheel of a golf cart by a quick connect coupling when not in use, thereby lessening the likelihood of harm; however, when demounted the brush must be separately stored and is prone to be misplaced. Additionally, the rigid wheel mounting can easily damage the brush and/or cart in the case of impact.

In view of the foregoing, it will be appreciated that there is a need for a cart mounted golf cleat cleaning device. The device should permit the brush to be readily, and rigidly supported for convenient use, but should provide for its safe and simple storage. Additionally, the device should be so configured so as to minimize damage or harm caused by inadvertent impact. As will be described in greater detail hereinbelow, the present invention includes, in a preferred embodiment, a golf cleat cleaning device which is mountable onto a golf cart and which is self-storing. The cleat cleaner of the present invention is, in the most preferred embodiment, maintained in a use position by a spring bias and thus may be easily moved to a storage position and vice versa. Additionally, the device of the present invention is never permanently locked in position and will flip out of the way without breaking or causing harm in the event of inadvertent impact. These and other advantages of the present invention will be readily apparent from the drawings, discussion and description which follow.

BRIEF DESCRIPTION OF THE INVENTION

There is disclosed herein, in one preferred embodiment, a golf cart mounted cleat cleaner which includes an attachment bracket which is configured to engage a portion of the golf cart. The cleaner further includes a brush plate which is configured as a generally planar member operable to support a brush on a top surface thereof. The cleat cleaner includes a hinge which pivotally connects a first end of the brush plate to the attachment bracket. The cleaner further includes a brace which has a first end pivotably attached to a bottom surface of the brush plate and a second end which is a free end. The brace may be readily deployed from a use position in which the free end thereof engages the golf cart or the attachment bracket so as to rigidly support the brush plate, to a storage position in which the free end is not engaged and the brush plate is not rigidly supported.

In particular embodiments, the attachment bracket includes a U-shaped channel which engages the golf cart, and the brush plate may include attachment clips for retaining a brush thereonto. The hinge which attaches the brush plate to the bracket may be a spring loaded hinge which in one embodiment, biases the plate toward a storage position, and in another embodiment, biases the plate toward a use position. The brace may, in some embodiments, comprise a plate, and may include an elastomeric stop member on the free end thereof. In other preferred embodiments, the attachment bracket may be configured to engage the free end of the brace.

BRIEF DESCRIPTION OF THE DRAWINGS

FIG. 1 is a perspective view of one embodiment of cleat cleaner structured in accord with the principles of the present invention;

FIG. 2 is a side elevational view of a cleat cleaner of the present invention shown in its use position;

FIG. 3 is a side elevational view of the cleaner of FIG. 2 shown in one stowed position;

FIG. 4 is a bottom plan view of a cleat cleaner of the present invention;

FIG. 5 is a cross-sectional view of a portion of a free end of the support bracket of one embodiment of cleat cleaner of the present invention;

FIG. 6 is a cross-sectional view of a portion of a cleat cleaner of the present invention illustrating the engagement of a free end of the brace with a portion of the attachment bracket.

DETAILED DESCRIPTION OF THE INVENTION

Figure 7:
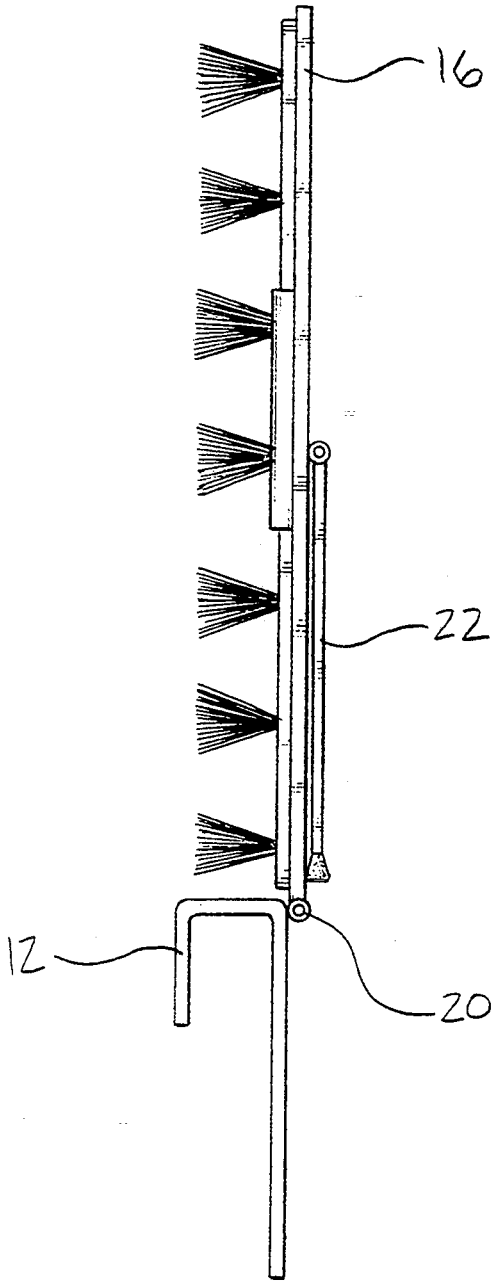
FIG. 7 is a side elevational view of another embodiment of cleat cleaner shown in an alternative, stowed position.

The present invention comprises a cleat cleaning device which is mountable onto a golf cart. FIG. 1 is a perspective view of one embodiment of cleat cleaner 10, structured in accord with the principles of the present invention. The cleaner includes an attachment bracket 12 which mounts the cleat cleaner 10 to a golf cart, not shown. Most preferably, the cleat cleaner 10 is mounted to the bag bay or bumper of the cart. In the illustrated embodiment, the attachment bracket 12 includes a series of drilled holes 14 therethrough which may be used to securely mount the cleaner 10 to the golf cart. Golf carts manufactured by the EZ-GO Corporation are particularly receptive to this mode of attachment, because the bag bay thereof is predrilled with accessory mounting holes. The cleat cleaner further includes a brush plate 16, which is a generally planar, preferably rectangular member. The brush plate is operable to support a brush thereupon, and in the illustrated embodiment, it includes a set of clips 18, or similar mounting means, for securing a brush 21 to the top surface thereof.

The brush plate 16 is affixed to the attachment bracket 12 in a manner which allows the brush plate 16 to pivot back and forth with at least one degree of freedom, in relation to the attachment bracket 12. As illustrated, the brush plate 16 is affixed to the attachment bracket 12 by means of a hinge 20, although it is to be understood that other structures such as a socket arrangement may be similarly employed. One particularly preferred embodiment of the present invention, the hinge 20 is a spring loaded hinge of the type known in the art, which is operable to urge the brush plate 16 in either an upward or a downward direction, as will be explained in detail hereinbelow.

The cleat cleaner 10 further includes a brace 22 which has a first end thereof pivotably connected to a bottom surface of the brush plate 16, as for example by means of a second hinge 24. The brace 22 also includes a free end 26, which is capable of engaging either the attachment bracket 12 or a portion of a golf cart to which the cleat cleaner is mounted. In the illustrated embodiment, the free end 26 of the brace 22 includes a rubber, or other elastomeric cap 28 which aids in retaining the free end against the bracket 12 or golf cart. FIG. 5 provides a detailed, cross-sectional drawing of a portion of a brace 22 having its free end 26 disposed in an elastomeric cap 28.

The operation of the present invention will be better illustrated with reference to FIGS. 2, 3 and 6, which show side elevational views of the cleat cleaner of FIG. 1. FIG. 2 depicts the cleat cleaner 10 in a use position, wherein the brush plate 16 is supported by the brace 22, in an orientation inclined at approximately 15 degrees to the horizontal. When the cleat cleaner 10 is supported in the use position as illustrated in FIG. 2, a golfer may easily clean his or her cleats by scraping them across the brush 21, and the golf cart can provide a hand-hold or other support for the golfer.

In a first embodiment of the invention, the spring loaded hinge biases the plate 16 and attached brace 22 into tight contact with the attachment bracket 12 so as to rigidly support the unit in the use position. FIG. 3 depicts this first embodiment of the cleat cleaner 10 in a storage position. In this configuration, the brush plate 16, and associated brush 21, are maintained in approximately vertical, downwardly directed orientation by the spring loaded hinge 20. The brace 22 also pivots downward permitting the cleat cleaner 10 to be folded into a relatively compact form. The cleat cleaner 10 may be readily deployed from the use position as illustrated in FIG. 2, to the storage position as shown in FIG. 3 by simply lifting on the brush plate 16 so as to permit the brace 22 to fall away from its support point on the attachment bracket 12 or golf cart. Once the brace 22 has disengaged, release of the brush plate 16 will cause the unit to fold under the spring bias. It will be noted in FIG. 3, that the brace 22 is disposed with the free end 26 in a downward position. It is to be understood that in some instances, the cleat cleaner 10 may be folded so that the free end 26 of the brace 22 is in an upward position, i.e., disposed so that it is retained near the spring loaded hinge 20 in the space defined between the attachment bracket 12 and brush plate 16.

In a second embodiment, the spring loaded hinge 20 is operative to bias the plate 16, in the opposite direction, so as to urge the plate 16 into an upwardly directed storage position as illustrated in FIG. 7. In this embodiment, the plate 16 and brush 21 are stored in a position which is raised above the bracket 12. In this embodiment, the spring loaded hinge 20 includes a detent mechanism of the type well known in the art which operates to overcome spring tension and maintain the plate in a roetastable use position, from which it may be released by a gentle push. Detent mechanisms of this type generally comprise a socket or a set of protrusions which engage and retain a portion of the hinge. To deploy the brush from the FIG. 7 storage position to the FIG. 2 use position, the plate is pulled down until it engages the detent and the brace 22 is positioned to engage the bracket 12 on golf cart. The spring loaded hinge 20 provides a safety factor to the cleat cleaner 10, since it will permit the brush plate 16 to swing out of the way, in both the use and storage positions, when struck by an obstacle.

Referring now to FIG. 4, there is shown a bottom plan view of the cleat cleaner 10 previously described. Illustrated in FIG. 4 is the bottom surface of the brush plate 16, the spring loaded hinge 20, the brace 22, the second hinge 24 which attaches the brace 22 to the brush plate 16, the rubber cap 28 on the brace 22 and the attachment bracket 12. Shown in phantom outline are a series of holes 14 formed in the attachment bracket 12 for mounting the cleat cleaner 10 onto a golf cart. It will be noted that the brace 22 is shown as a generally rectangular member of a somewhat narrower width than the width of the brush plate 16. It should be understood that within the scope of the present invention, the brace 22 may be otherwise configured. For example, the brace may be co-extensive with the entire width of the brush plate 16. Alternatively, the brace may be configured as a set of legs, or as a framework made from wire or the like.

Various other configurations of the cleat cleaner may be fabricated in keeping with the spirit of the present invention. For example, FIG. 6 depicts a portion of a cleat cleaner device in which the attachment bracket 12 includes a recess 30 formed therein by scribing, stamping, coining or the like. This recess 30 receives and retains the free end 26 of the brace 22. It is also to be understood that in some instances, no particular preparation of the free end 26 of the brace 22 or of any other portion of the cleat cleaner is necessary; and in such instances, the free end 26 may simply rest against the golf cart or bracket.

The cleat cleaner 10 of the present invention is preferably manufactured from metal such as mild steel, aluminum and the like or from relatively high strength polymers such as nylons, ABS and other such engineering plastics. The brush may be permanently mounted onto the brush plate, or more preferably, the brush may be replaceable, as illustrated in the FIG. 1 embodiment wherein a set of brush clips 18 retains the brush for ready replacement. In one preferred embodiment, the brush plate is approximately six inches long and four inches wide. While the present invention has primarily been described with reference to its use in connection with golf carts and golf cleats, it will be understood that the device of the present invention may be similarly employed in connection with other vehicles. For example, the brush assembly may be mounted onto an automobile to permit passengers to clean their shoes before entry. In view of the foregoing, it will be understood that numerous modifications and variations of the present invention may be implemented in accord with the teaching herein. The foregoing drawings, discussion and description are merely meant to illustrate particular embodiments of the invention and are not meant to be limitations upon the practice thereof. It is the following claims, including all equivalents, which define the scope of the invention.

I claim:

1. A golf cart mounted cleat cleaner comprising:

an attachment bracket configured to engage a portion of a golf cart;

a brush plate configured as a generally planar member which is operable to support a brush upon a top surface thereof;

a hinge which pivotably connects a first end of the brush plate to the attachment bracket;

a brace having a first end thereof which is pivotably attached to a bottom surface of the brush plate at an attachment point, and a second end thereof which is a free end, said brace being deployable from a use position in which the free end thereof engages the golf cart or the attachment bracket so as to rigidly support the brush plate, to a storage position in which the free end does not engage the golf cart or the attachment bracket and the brush plate is not rigidly supported.

2. A cleat cleaner as in claim 1, wherein said attachment member includes a U-shaped channel which is configured to engage a portion of a golf cart.

3. A cleat cleaner as in claim 2, wherein said attachment bracket includes a plurality of mounting holes defined therethrough.

4. A cleat cleaner as in claim 1, wherein the hinge which pivotably connects the first end of the brush plate to the attachment bracket comprises a spring loaded hinge.

5. A cleat cleaner as in claim 4, wherein said spring loaded hinge is operative to bias the brush plate toward the brace.

6. A cleat cleaner as in claim 4, wherein said spring loaded hinge is operable to bias the brush plate to said storage position.

7. A cleat cleaner as in claim 1, wherein said brush plate includes at least one clip for retaining a brush thereupon.

8. A cleat cleaner as in claim 1, wherein said brush plate is a rectangular plate which is approximately six inches long and four inches wide.

9. A golf cleat cleaner as in claim 1, wherein said brace comprises a generally rectangular member.

10. A cleat cleaner as in claim 1, wherein the free end of said brace includes an elastomeric member attached thereto.

11. A cleat cleaner as in claim 1, wherein said attachment bracket is configured to engage the free end of the brace when the brace is deployed in a use position.

12. A golf cart mounted cleat cleaner comprising an attachment bracket configured to engage a portion of a golf cart;

a brush plate configured as a generally planar, rectangular member, including at least one clip for retaining a brush on a top surface thereof;

a spring loaded hinge which pivotably connects the first end of the brush plate to the attachment bracket and which is further operable to bias the brush plate in a direction generally extending from the top surface, to a bottom surface of the brush plate to the top surface thereof;

a brace having a first end thereof pivotably attached to the bottom surface of the brush plate by a hinge, said brace including a second end which is a free end, wherein said brace is deployable from a use position in which the free end engages the golf cart or the attachment bracket so as to rigidly support the brush plate, to a storage position in which the free end of the brace does not engage the golf cart or the attachment bracket and the brush plate is not rigidly supported.

* * * * *